US008269702B2

(12) United States Patent
Kim

(10) Patent No.: US 8,269,702 B2
(45) Date of Patent: Sep. 18, 2012

(54) ORGANIC LIGHT EMITTING DISPLAY DEVICE AND METHOD OF DRIVING THE SAME

(75) Inventor: Do-Ik Kim, Yongin (KR)

(73) Assignee: Samsung Display Co., Ltd., Yongin (KR)

( * ) Notice: Subject to any disclaimer, the term of this patent is extended or adjusted under 35 U.S.C. 154(b) by 566 days.

(21) Appl. No.: 12/484,787

(22) Filed: Jun. 15, 2009

(65) Prior Publication Data

US 2010/0013867 A1 Jan. 21, 2010

(30) Foreign Application Priority Data

Jul. 17, 2008 (KR) ..... 10-2008-0069528

(51) Int. Cl.
*G09G 3/30* (2006.01)
*G09G 5/00* (2006.01)
*G09G 5/10* (2006.01)

(52) U.S. Cl. ..... 345/77; 345/211; 345/690

(58) Field of Classification Search ..... 345/211, 345/76–77

See application file for complete search history.

(56) References Cited

U.S. PATENT DOCUMENTS 7,593,008 B2 * 9/2009 Yamada ..... 345/204
2003/0122813 A1 * 7/2003 Ishizuki et al. ..... 345/211
2006/0267881 A1 * 11/2006 Jeon et al. ..... 345/75.2
2007/0091049 A1 * 4/2007 Cho ..... 345/98
2007/0164937 A1 * 7/2007 Jung et al. ..... 345/76

FOREIGN PATENT DOCUMENTS

JP 2006-343763 12/2006
KR 2003-0085185 11/2003
KR 10-2006-0078584 7/2006
KR 10-0707615 4/2007
KR 10-2007-0121287 12/2007

* cited by examiner

*Primary Examiner* — Alexander S Beck
*Assistant Examiner* — Nguyen Truong
(74) *Attorney, Agent, or Firm* — Christie, Parker & Hale, LLP

(57) ABSTRACT

An organic light emitting display device and a method of driving the same. The organic light emitting display device includes a scan driver, a data driver for supplying data signals, and pixels. Each of the pixels is configured to control whether or not a current flows from a first power to a second power both coupled to the pixels, the current corresponding to a corresponding one of the data signals. A power supply is included for supplying the first power to a power line coupled to the pixels. A sensing resistor is coupled between the power supply and the power line. A power controller is provided for controlling the power supply to adjust a voltage value of the first power for controlling an amount of current that flows through the sensing resistor to be substantially equal to an amount of current corresponding to data of a current frame.

16 Claims, 6 Drawing Sheets

ORGANIC LIGHT EMITTING DISPLAY DEVICE AND METHOD OF DRIVING THE SAME

CROSS-REFERENCE TO RELATED APPLICATIONS

This application claims priority to and the benefit of Korean Patent Application No. 10-2008-0069528, filed on Jul. 17, 2008, in the Korean Intellectual Property Office, the entire content of which is incorporated herein by reference.

BACKGROUND OF THE INVENTION

1. Field of the Invention

The present invention relates to an organic light emitting display device and a method of driving the same.

2. Description of Related Art

Recently, there have been various types of flat panel display devices with reduced weight and volume in comparison to cathode ray tube display devices. The flat panel display devices include a liquid crystal display device, a field emission display device, a plasma display panel, an organic light emitting display device, and the like.

Among these flat panel display devices, the organic light emitting display device displays images by using organic light emitting diodes (OLEDs) that emit light through recombination of electrons and holes. The organic light emitting display device has a fast response time and is capable of being driven with low power consumption.

FIG. 1 is a schematic circuit diagram showing a conventional pixel of an organic light emitting display device.

Referring to FIG. 1, the conventional pixel 4 of the organic light emitting display device includes an organic light emitting diode OLED and a pixel circuit 2 coupled to data a line Dm and a scan line Sn for controlling the organic light emitting diode OLED.

An anode electrode of the organic light emitting diode OLED is coupled to the pixel circuit 2, and a cathode electrode of the organic light emitting diode OLED is coupled to a second power source ELVSS. The organic light emitting diode OLED emits light with a luminance (e.g., a predetermined luminance), corresponding to a current supplied from the pixel circuit 2.

When a scan signal is supplied to the scan line Sn, the pixel circuit 2 controls an amount of current supplied to the organic light emitting diode OLED, corresponding to a data signal supplied through the data line Dm. To this end, the pixel circuit 2 includes a second transistor M2 coupled between a first power source ELVDD and the organic light emitting diode OLED; a first transistor M1 coupled to the second transistor M2, the data line Dm and the scan line Sn; and a storage capacitor Cst coupled between a gate electrode of the second transistor M2 and a first electrode of the second transistor M2.

A gate electrode of the first transistor M1 is coupled to the scan line Sn, and a first electrode of the first transistor M1 is coupled to the data line Dm. A second electrode of the first transistor M1 is coupled to one terminal of the storage capacitor Cst. Here, the first electrode is one of the source and drain electrodes, and the second electrode is the other one of the source and drain electrodes. For example, if the first electrode is a source electrode, the second electrode is a drain electrode. When a scan signal is supplied from the scan line Sn, the first transistor M1 coupled to the scan line Sn and the data line Dm is turned on to supply a data signal supplied from the data line Dm to the storage capacitor Cst. Accordingly, a voltage corresponding to the data signal is charged into the storage capacitor Cst.

The gate electrode of the second transistor M2 is coupled to one terminal of the storage capacitor Cst, and the first electrode of the second transistor M2 is coupled to the other terminal of the storage capacitor Cst and the first power source ELVDD. A second electrode of the second transistor M2 is coupled to the anode electrode of the organic light emitting diode OLED. The second transistor M2 controls an amount of current supplied to the second power source ELVSS via the organic light emitting diode OLED from the first power source ELVDD, corresponding to a voltage value stored in the storage capacitor Cst. Here, the organic light emitting diode OLED emits light corresponding to an amount of current supplied from the second transistor M2.

Typically, the conventional pixel 4 of the organic light emitting display device displays an image having a predetermined luminance by repeating the aforementioned process. In a digital driving method in which the second transistor M2 is operated as a switch, first power ELVDD and second power ELVSS are supplied to the organic light emitting diode OLED as they are, and accordingly, the organic light emitting diode OLED emits light by constant voltage driving. As such, in the digital driving method, the amount of current driving the organic light emitting diode OLED sensitively varies according to temperature variations and an increase in resistance caused by the degradation of the organic light emitting diode OLED. Therefore, an image having a desired luminance may not be displayed.

More specifically, an amount of current supplied from the pixel circuit 2 to the organic light emitting diode OLED is generally changed corresponding to the change of temperature. Therefore, the luminance of an image displayed may be changed corresponding to the change of temperature. Further, the organic light emitting diode OLED may be degraded as time elapses. When the organic light emitting diode OLED is degraded, its resistance increases. Accordingly, a current that flows into the degraded organic light emitting diode OLED is decreased corresponding to the same voltage difference across the organic light emitting diode OLED, and therefore the luminance may be lowered.

SUMMARY OF THE INVENTION

Accordingly, it is an aspect of the present invention to provide an organic light emitting display device capable of displaying an image substantially having a desired luminance regardless of temperature variations and degradation of an organic light emitting diode included in a pixel, and a method of driving the same.

According to an embodiment of the present invention, an organic light emitting display device includes: a scan driver for supplying a scan signal to scan lines during scan periods of a plurality of sub-frames included in one frame; a data driver for supplying data signals to data lines when the scan signal is supplied; pixels at crossing regions of the scan lines and the data lines, each of the pixels configured to control whether or not a current flows from a first power to a second power both coupled to the pixels, the current corresponding to corresponding one of the data signals; a power supply for supplying the first power to a power line coupled to the pixels; a sensing resistor coupled between the power supply and the power line; and a power controller for controlling the power supply to adjust a voltage value of the first power to correspond to an amount of current that flows through the sensing resistor and data of a current frame.

The power controller may include a first generator for generating a first comparative value by utilizing the current that flows through the sensing resistor and an amount of current that would flow through the sensing resistor if the pixels emit full white light, a second generator for generating a second comparative value by utilizing the data of the current frame and data of one frame in which the pixels emit full white light, a comparator for generating a control signal while comparing the first comparative value with the second comparative value, and a controller for controlling the power supply in accordance with the control signal so that the first comparative value is substantially identical to the second comparative value.

The first generator may include an amplifier for sensing an amount of current flowing across the sensing resistor, an analog-to-digital converter for converting the amount of current sensed by the amplifier to a second digital value, a first memory for storing a first digital value corresponding to the current that flows across the sensing resistor when the pixels emit full white light, and a first calculator for generating the first comparative value by dividing the second digital value by the first digital value.

The second generator may include a second memory for storing a third digital value obtained by adding the data for one frame in which the pixels emit full white light, a third calculator for generating a fourth digital value by adding the data of the current frame, and a second calculator for generating the second comparative value by dividing the fourth digital value by the third digital value.

According to an embodiment of the present invention, an organic light emitting display device includes: a scan driver for supplying a scan signal to scan lines during scan periods of a plurality of sub-frames included in one frame; a data driver for supplying data signals to data lines when the scan signal is supplied; a display unit including red pixels, green pixels and blue pixels; a first power supply for supplying a red first power to a first power line coupled to the red pixels; a second power supply for supplying a green first power to a second power line coupled to the green pixels; a third power supply for supplying a blue first power to a third power line coupled to the blue pixels; a first sensing resistor coupled between the first power supply and the first power line; a second sensing resistor coupled between the second power supply and the second power line; a third sensing resistor coupled between the third power supply and the third power line; a first power controller for controlling the first power supply to adjust a voltage value of the red first power to correspond to an amount of current that flows through the first sensing resistor and red data of a current frame; a second power controller for controlling the second power supply to adjust a voltage value of the green first power to correspond to an amount of current that flows through the second sensing resistor and green data of the current frame; and a third power controller for controlling the third power supply to adjust a voltage value of the blue first power to correspond to an amount of current that flows through the third sensing resistor and blue data of the current frame.

Each of the first power controller, the second power controller and the third power controller may include: a first generator for generating a first comparative value by utilizing the amount of current that flows through a sensing resistor of the first sensing resistor, the second sensing resistor or the third sensing resistor and a current that flows through the sensing resistor when the red pixels, the green pixels and the blue pixels emit full white light; a second generator for generating a second comparative value by utilizing corresponding data of the red data, the green data or the blue data of the current frame and corresponding data of red data, green data or blue data of one frame in which the red pixels, the green pixels and the blue pixels emit full white light; a comparator for generating a control signal while comparing the first comparative value with the second comparative value; and a controller for controlling a corresponding one of the first power supply, the second power supply or the third power supply in accordance with the control signal so that the first comparative value is substantially identical to the second comparative value.

According to an embodiment of the present invention, a method of driving an organic light emitting display device driven with one frame divided into a plurality of sub-frames is provided. The method includes: storing a first digital value corresponding to a current that flows to pixels of the organic light emitting display when the pixels emit full white light; storing a third digital value obtained by adding data corresponding to the full white light; converting a current that flows to the pixels in a current frame into a second digital value, and generating a first comparative value by utilizing the first digital value and the second digital value; generating a fourth digital value by adding data of the current frame to generate a second comparative value by utilizing the third digital value and the fourth digital value; and controlling a voltage value of a first power for supplying a current to the pixels so that the first comparative value is substantially identical to the second comparative value.

The first comparative value may be generated by dividing the second digital value by the first digital value. The second comparative value may be generated by dividing the fourth digital value by the third digital value. The pixels may include a red pixel for emitting red light, a green pixel for emitting green light, and a blue pixel for emitting blue light. The first digital value may include a plurality of first digital values each corresponding to the red pixel, the green pixel or the blue pixel. The third digital value may include a plurality of third digital values each corresponding to red data supplied to the red pixel, green data supplied to the green pixel or blue data supplied to the blue pixel.

The fourth digital value may include a plurality of fourth digital values each corresponding to red data, green data or blue data generated in the current frame. Said controlling the voltage value of the first power may include controlling a voltage value of red first power, green first power or blue first power for controlling a current supplied to a corresponding one of the red pixel, the green pixel or the blue pixel.

In an organic light emitting display device and a method of driving the same according to the embodiments of the present invention, since an amount of current that flows in an actual pixel is controlled by using data, an image having a desired luminance can be displayed regardless of temperature variations and degradation of an organic light emitting diode included in the pixel.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF EXEMPLARY EMBODIMENTS

Figure 1:
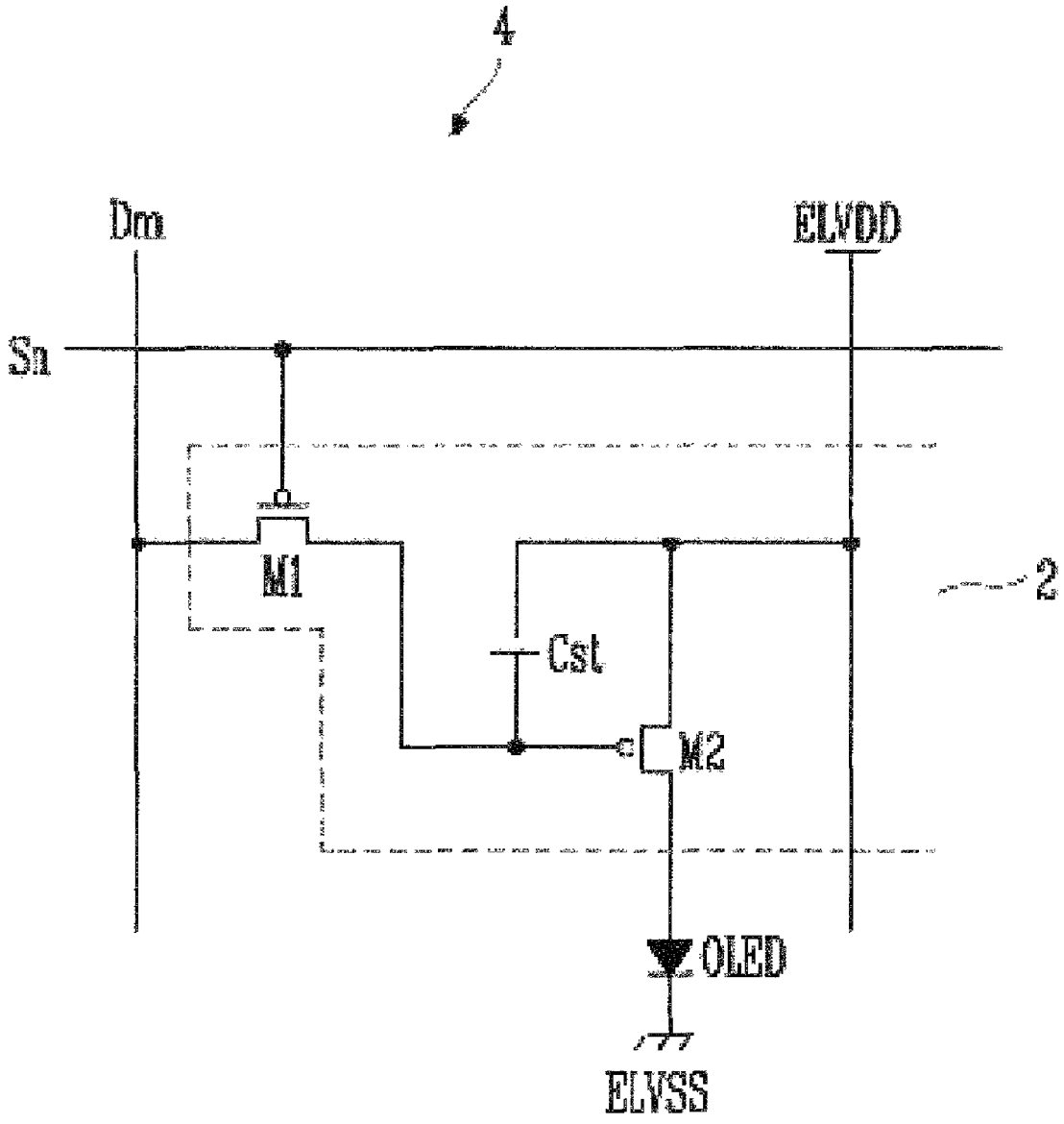
FIG. 1 is a schematic circuit diagram of a conventional pixel.

Hereinafter, certain exemplary embodiments according to the present invention will be described with reference to the accompanying drawings. Here, when a first element is described as being coupled to a second element, the first element may be directly coupled to the second element or indirectly coupled to the second element via a third element. Further, some of the elements that are not essential to a complete understanding of the present invention are omitted for clarity. Also, like reference numerals refer to like elements throughout.

Figure 2:
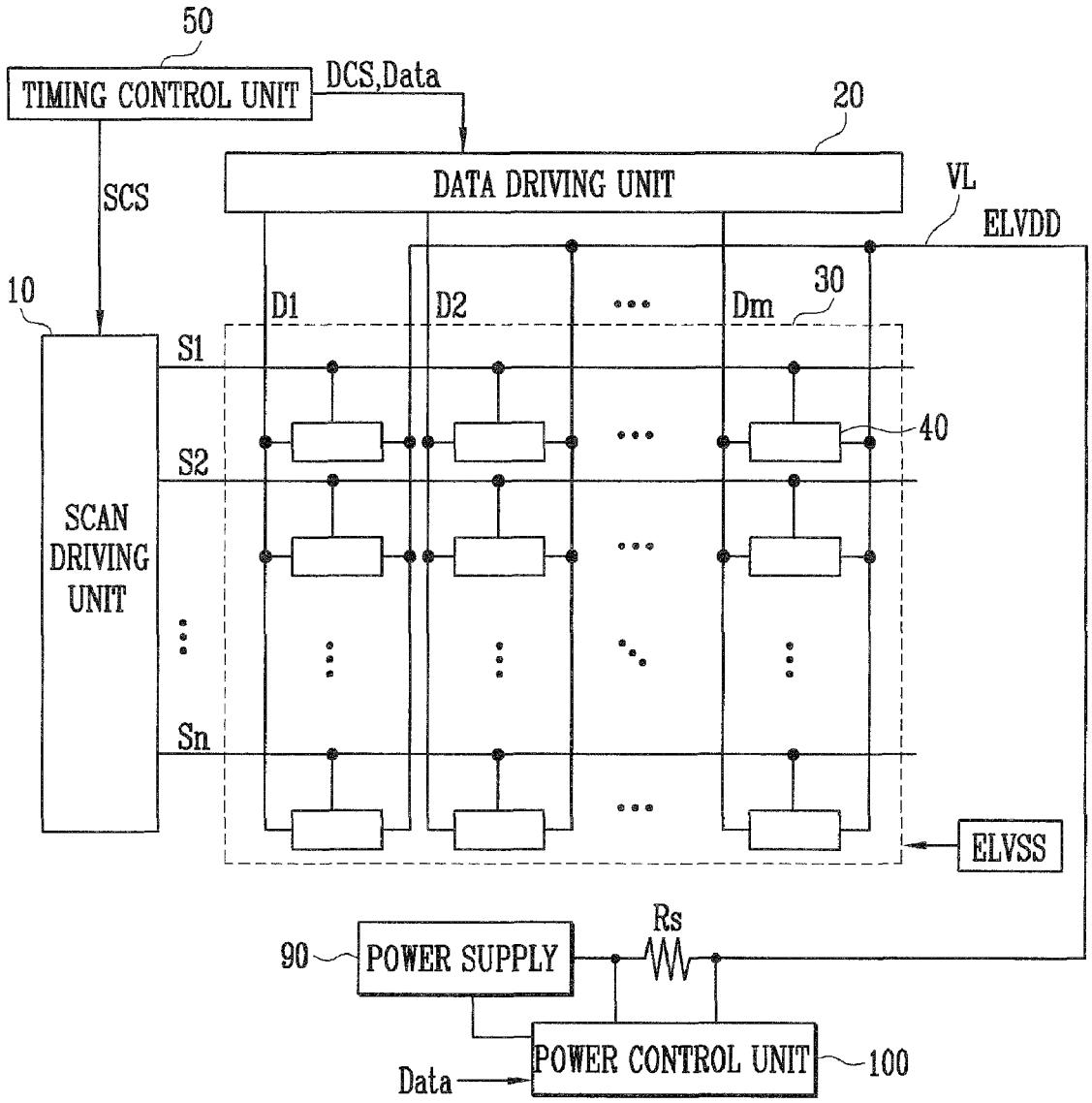
FIG. 2 is a schematic block diagram of an organic light emitting display device according to an embodiment of the present invention.

FIG. 2 is a schematic block diagram of an organic light emitting display device according to an embodiment of the present invention.

Referring to FIG. 2, the organic light emitting display device according to the embodiment of the present invention includes a display unit 30 having a plurality of pixels 40 coupled to scan lines S1 to Sn and data lines D1 to Dm; a scan driver 10 for driving the scan lines S1 to Sn; a data driver 20 for driving the data lines D1 to Dm; a timing controller 50 for controlling the scan driver 10 and the data driver 20; a power supply 90 for generating first power ELVDD; and a power controller 100 for controlling the power supply 90.

The timing controller 50 generates a data driving control signal DCS and a scan driving control signal SCS, corresponding to synchronization signals supplied from the outside of the organic light emitting display device. The data driving control signal DCS generated from the timing controller 50 is supplied to the data driver 20, and the scan driving control signal SCS generated from the timing controller 50 is supplied to the scan driver 10. The timing controller 50 supplies externally supplied data Data to the data driver 20.

Figure 3:
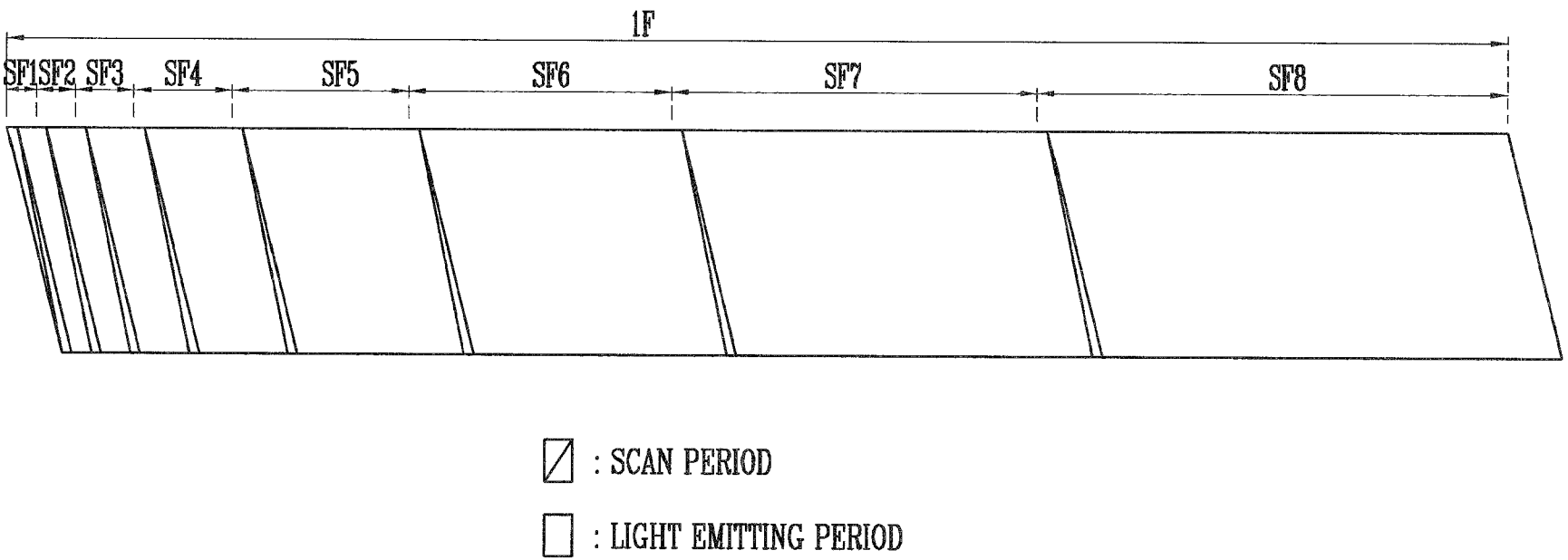
FIG. 3 is a schematic diagram for illustrating one frame according to an embodiment of the present invention.

The scan driver 10 supplies a scan signal to the scan lines S1 to Sn. Here, the scan driver 10 supplies a scan signal to the scan lines S1 to Sn for each scan period of a plurality of sub-frames SF1 to SF8 included in one frame 1F as shown in FIG. 3. When a scan signal is supplied to the scan lines S1 to Sn, pixels 40 are selected per each scan line, and the selected pixels 40 receive respective data signals supplied from the data lines D1 to Dm.

The data driver 20 supplies a data signal to the data lines D1 to Dm whenever a scan signal is supplied during the scan period of each of the sub-frames SF1 to SF8. Then, the data signal is supplied to the pixels 40 selected by the scan signal. The data driver 20 supplies data signals that include a first data signal with which the pixels 40 emit light and a second data signal with which the pixels 40 do not emit light. Furthermore, the pixels 40 that receive the first data signal supplied during a light emitting period of each of the sub-frames emit light during a predetermined period (e.g., the period of each of the sub-frames), thereby displaying an image having a corresponding luminance (e.g., a predetermined luminance).

The display unit 30 supplies first power ELVDD supplied from the power supply 90 to the pixels 40 via a power line VL. The pixels 40 of the display unit 30 are supplied with a first power ELVDD and a second power ELVSS supplied from the outside. Each of the pixels 40 that receives the first power ELVDD and the second power ELVSS receives a data signal supplied when a scan signal is supplied. Each of the pixels 40 emits light or does not emit light, corresponding to the supplied data signal. Here, the voltage value of the first power ELVDD has a higher value than that of the second power ELVSS.

The power supply 90 generates the first power ELVDD and supplies it to the power line VL.

A sensing resistor Rs is positioned between the power supply 90 and the power line VL. The amount of current that flows through the sensing resistor Rs corresponds to the load of the pixels 40.

The power controller 100 controls the power supply 90 so that an image having a desired luminance can be displayed regardless of temperature variations and degradation of the organic light emitting diode included in each of the pixels 40. The power supply 90 controls the voltage of the first power ELVDD under the control of the power controller 100.

An operational principle of the power controller 100 will be described in more detail. First of all, in a digital driving method, the average value of currents that flow into the respective pixels 40 is in proportion to the time duration in which a driving transistor is turned on, i.e., turned on by corresponding data Data. Furthermore, the power controller 100 controls the power supply 90 so that currents determined by the data Data can flow into the actual pixels 40.

Figure 4:
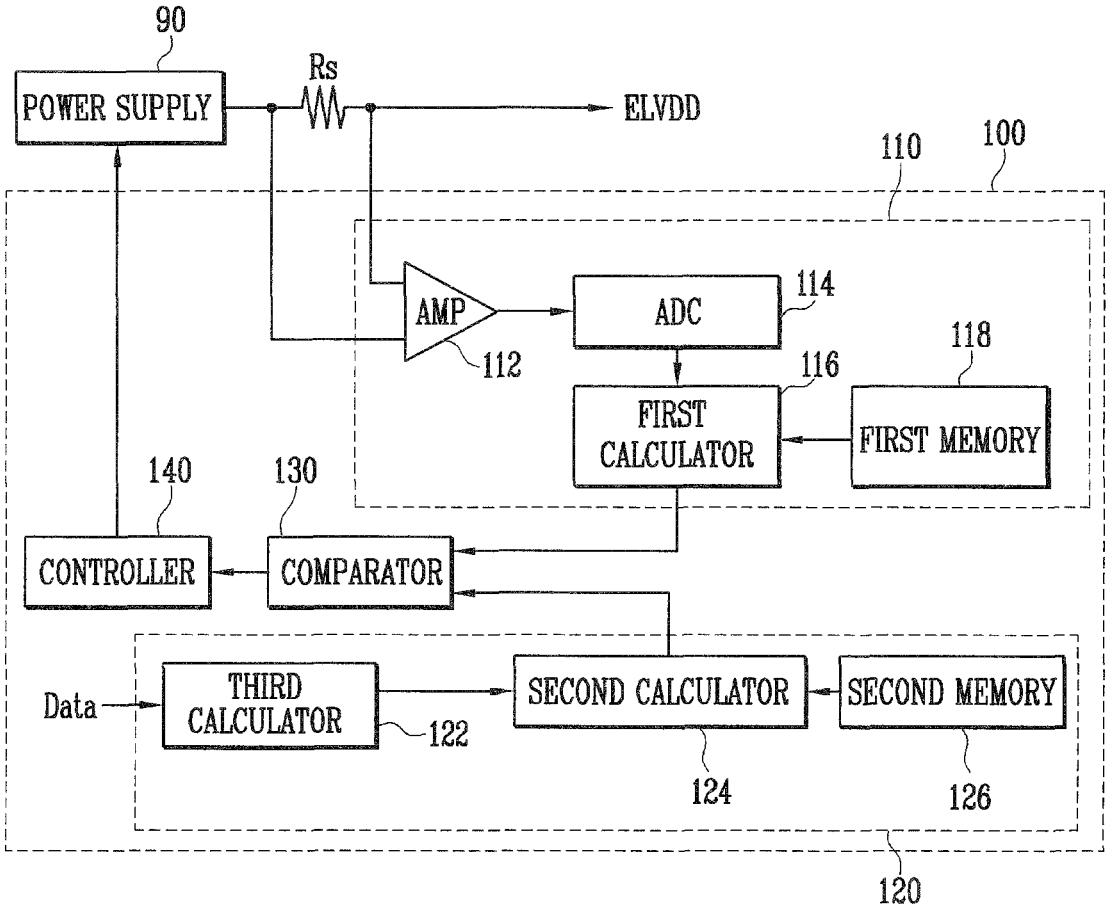
FIG. 4 is a schematic block diagram of a power controller shown in FIG. 2.

FIG. 4 is a detailed schematic block diagram of a power controller shown in FIG. 2.

Referring to FIG. 4, the power controller 100 includes a first generator 110 for generating a first comparative value by using the current that flows through the sensing resistor Rs; a second generator 120 for generating a second comparative value corresponding to the current that flows in the actual pixels 40 by using data Data; a comparator 130 for comparing the first comparative value with the second comparative value; and a controller 140 for controlling the power supply 90 so that the first comparative value is identical or substantially identical to the second comparative value, corresponding to the compared result of the comparator 130.

The first generator 110 generates a first comparative value by using the current that flows through the sensing resistor Rs when displaying full white light in the display unit 30 and the current presently (e.g., real-time) sensed by the sensing resistor Rs. To this end, the first generator 110 includes an amplifier 112, an analog-to-digital converter 114 (hereinafter, referred to as an "ADC"), a first calculator 116 and a first memory 118.

The first memory 118 stores a first digital value corresponding to the current that flows through the sensing resistor Rs when displaying full white light. The first digital value may be changed depending on a temperature at which the organic light emitting display device is driven. Therefore, in some embodiments of the present invention, the current that flows through the sensing resistor Rs when displaying full white light is stored as the first digital value at a temperature of 10 to 30° C., e.g., 25° C., at which the organic light emitting display device can be stably driven.

The amplifier 112 senses the current that flows through the sensing resistor Rs. To this end, the amplifier 112 is set as a current sensing amplifier.

The ADC 1 14 converts the current sensed by the amplifier 112 into a second digital value.

The first calculator 116 divides the second digital value by the first digital value to generate a first comparative value. Therefore, the first comparative value includes information on the current that actually flows in the display unit 30.

The second generator 120 generates a second comparative value by using a third digital value obtained by adding the bit values of the data Data corresponding to displaying full white light and a fourth digital value obtained by adding the bit values of the data Data of a current frame. To this end, the second generator 120 includes a third calculator 122, a second calculator 124 and a second memory 126.

The second memory 126 stores the third digital value obtained by adding the bit values of the data Data corresponding to one frame that displays full white light.

The third calculator 122 generates the fourth digital value by adding the bit values of the data Data corresponding to the current frame.

The second calculator 124 divides the fourth digital value by the third digital value to generate the second comparative value.

The comparator 130 compares the first comparative value with the second comparative value. Here, when the first comparative value is greater than the second comparative value, the comparator 130 outputs a high (or low) control signal. When the first comparative value is smaller than the second comparative value, the comparator 130 outputs a low (or high) control signal.

The controller 140 controls the power supply 90 in accordance with the control signal so that the first comparative value is identical or substantially identical to the second comparative value. For instance, the power supply 90 adjusts the voltage value of the first power ELVDD so that the first comparative value is identical or substantially identical to the second comparative value.

An operation of the power controller 100 will be described in more detail. The power supply 90 first generates the first power ELVDD and supplies the generated first power ELVDD to the display unit 30. Therefore, a corresponding current flows through the sensing resistor Rs, and the amplifier 112 senses the current that flows through the sensing resistor Rs to supply the sensed current to the ADC 114.

The current supplied to the ADC 114 is converted into a second digital value to be supplied to the first calculator 116. Here, the first calculator 116 generates the first comparative value by using the second digital value and the first digital value stored in the first memory 118, and supplies the generated first comparative value to the comparator 130.

The third calculator 122 generates the fourth digital value by adding the bit values of the data Data corresponding to a current frame and supplies the generated fourth digital value to the second calculator 124. Here, the second calculator 124 generates the second comparative value by using the fourth digital value and the third digital value stored in the second memory 126, and supplies the generated second comparative value to the comparator 130.

The comparator 130, which receives the first and second comparative values respectively supplied from the first and second calculators 116 and 124, generates a control signal corresponding to the compared result and supplies the generated control signal to the controller 140. In accordance with the control signal from the comparator 130, the controller 140 adjusts the voltage value of the first power ELVDD by controlling the power supply 90 so that the first comparative value is identical or substantially identical to the second comparative value.

As described above, in the organic light emitting display device according to the embodiment of the present invention, the voltage value of the first power ELVDD is controlled so that the first comparative value generated by the current that flows in the pixels 40 is identical or substantially identical to the second comparative value generated by using the data Data. Therefore, the current that flows in the pixels 40 is determined by the data Data regardless of temperature variations and degradation of the organic light emitting diode included in each of the pixels 40. Accordingly, an image having a desired luminance can be displayed.

Figure 5:
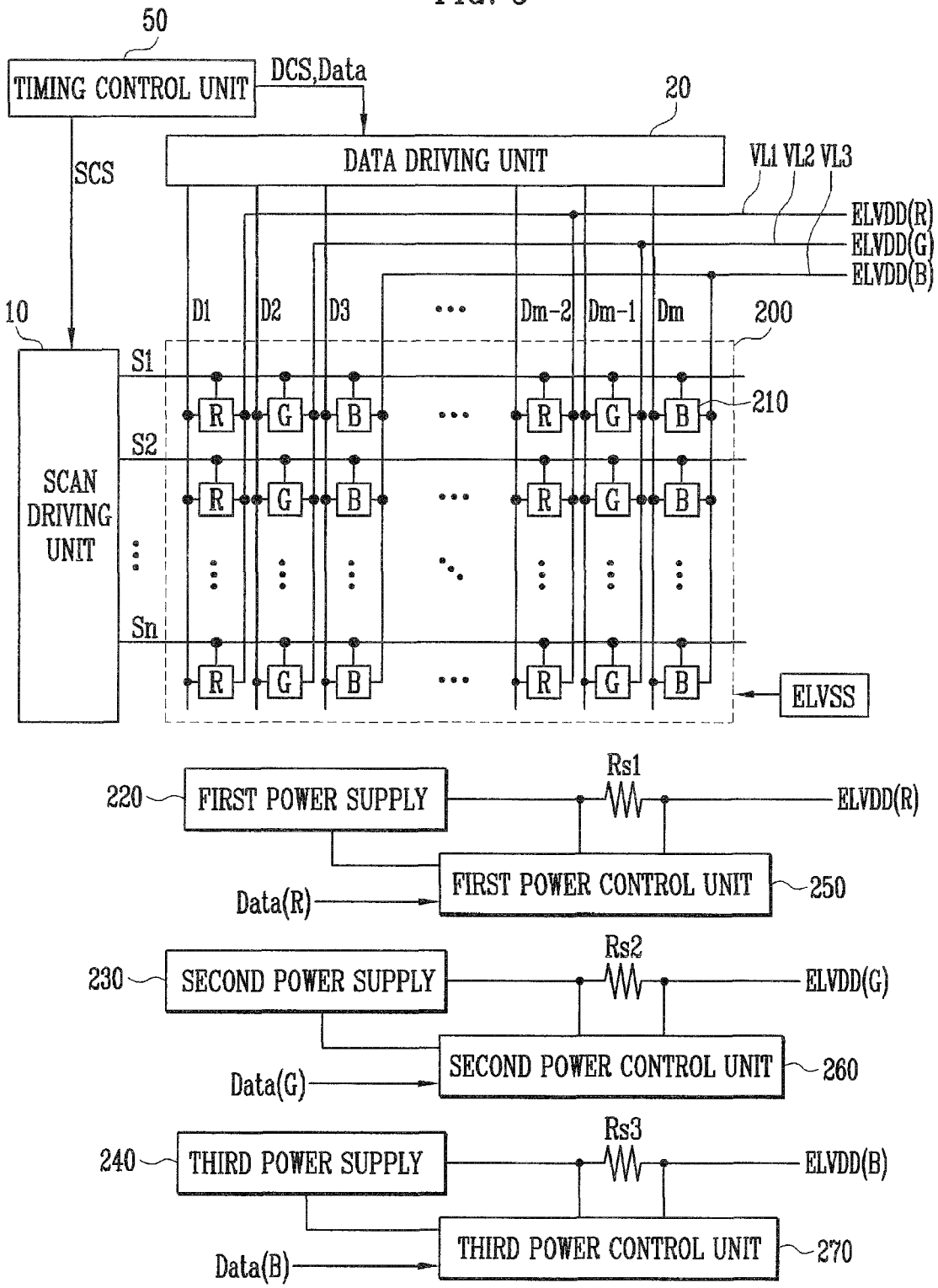
FIG. 5 is a schematic block diagram of an organic light emitting display device according to another embodiment of the present invention.

FIG. 5 is a schematic block diagram of an organic light emitting display device according to another embodiment of the present invention. In FIG. 5, like reference numerals are assigned to like elements corresponding to those of FIG. 2, and their detailed descriptions will be omitted.

Referring to FIG. 5, the organic light emitting display device according to the embodiment of the present invention includes a display unit 200 having a plurality of pixels 210 positioned at crossing regions of scan lines S1 to Sn and data lines D1 to Dm; a scan driver 10 for driving the scan lines S1 to Sn; a data driver 20 for driving the data lines D1 to Dm; a timing controller 50 for controlling the scan driver 10 and the data driver 20; a first power supply 220 for supplying a red first power ELVDD(R) to red pixels R; a second power supply 230 for supplying a green first power ELVDD(G) to green pixels G; a third power supply 240 for supplying a blue first power ELVDD(B) to blue pixels B; a first power controller 250 for controlling the first power supply 220; a second power controller 260 for controlling the second power supply 230; and a third power controller 270 for controlling the third power supply 240.

The display unit 200 includes the red pixels R, the green pixels G and the blue pixels B. The display unit 200 displays an image having a gray level (e.g., a predetermined gray level) by using the light generated from the red, green and blue pixels R, G and B.

The red pixels R receive the red first power ELVDD(R) supplied via a first power line VL1. The red pixels R receive data signals respectively supplied from the data lines D1, D4, . . . , and Dm-2, and emit or do not emit red light in accordance with the supplied data signals.

The green pixels G receive the green first power ELVDD (G) supplied via a second power line VL2. The green pixels G receive data signals respectively supplied from data lines D2, D5, . . . , and Dm-1, and emit or do not emit green light corresponding to the supplied data signals.

The blue pixels B receive the blue first power ELVDD(B) supplied via a third power line VL3. The blue pixels B receive data signals respectively supplied from data lines D3, D6, . . . , and Dm, and emit or do not emit blue light in accordance with the supplied data signals.

The first power supply 220 generates the red first power ELVDD(R) and supplies the generated red first power ELVDD(R) to the first power line VL1. A first sensing resistor Rs1 is positioned between the first power supply 220 and the first power line VL1. Therefore, a current (e.g., a predetermined current) corresponding to the load of the red pixels R flows through the first sensing resistor Rs1.

The first power controller 250 controls the first power supply 220 to generate the red first power ELVDD(R) by using the current that flows through the first sensing resistor Rs1 and red data Data(R), so that an image having a desired luminance can be displayed regardless of temperature variations and degradation of the organic light emitting diode included in each of the red pixels R.

The second power supply 230 generates the green first power ELVDD(G) and supplies the generated green first power ELVDD(G) to the second power line VL2. A second sensing resistor Rs2 is positioned between the second power supply 230 and the second power line VL2. Therefore, a current (e.g., a predetermined current) corresponding to the load of the green pixels G flows through the second sensing resistor Rs2.

The second power controller 260 controls the second power supply 230 to generate the green first power ELVDD (G) by using the current that flows through the second sensing resistor Rs2 and green data Data(G), so that an image having a desired luminance can be displayed regardless of temperature variations and degradation of the organic light emitting diode included in each of the green pixels G.

The third power supply 240 generates the blue first power ELVDD(B) and supplies the generated blue first power ELVDD(B) to the third power line VL3. A third sensing resistor Rs3 is positioned between the third power supply 240 and the third power line VL3. Therefore, a current (e.g., a predetermined current) corresponding to the load of the blue pixels G flows through the third sensing resistor Rs3.

The third power controller 270 controls the third power supply 240 to generate the blue first power ELVDD(B) by using the current that flows through the third sensing resistor Rs3 and blue data Data(B), so that an image having a desired luminance can be displayed regardless of temperature variations and degradation of the organic light emitting diode included in each of the blue pixels B.

In the embodiment shown in FIG. 5, the configurations of the first, second and third power controllers 250, 260 and 270 are substantially identical. Hereinafter, the configuration of a power controller will be described using the first power controller 250 only for convenience of illustration.

Figure 6:
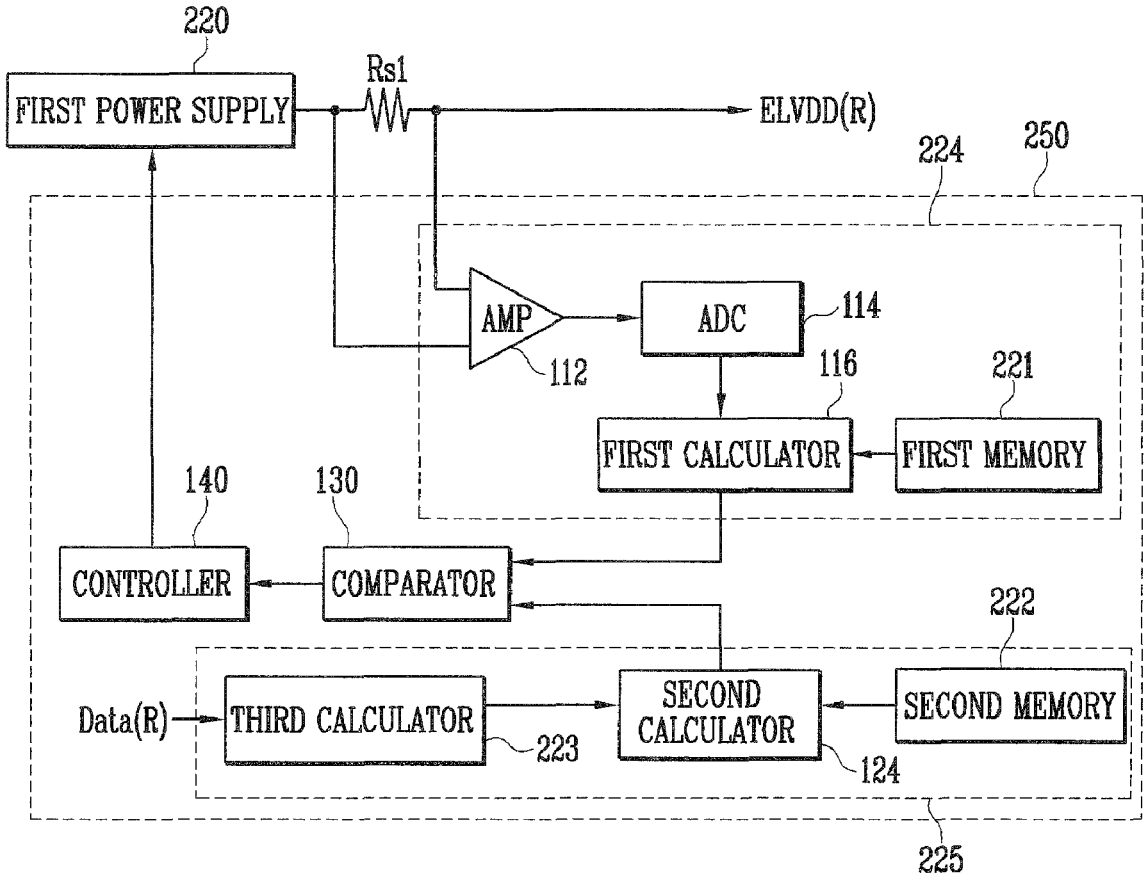
FIG. 6 is a schematic block diagram of a power controller shown in FIG. 5.

FIG. 6 is a schematic block diagram of a power controller shown in FIG. 5. In FIG. 6, the configuration of the first power controller 250 is substantially identical to that of the power controller 100 shown in FIG. 4. Therefore, like reference numerals are assigned to like elements corresponding to those of FIG. 4, and their detailed descriptions will be omitted.

Referring to FIG. 6, the first power controller 250 includes a first generator 224 for generating a first comparative value by using the current that flows through the first sensing resistor Rs1; a second generator 225 for generating a second comparative value corresponding to the current that flows in the red pixels R according to red data Data(R); a comparator 130 for comparing the first comparative value with the second comparative value; and a controller 140 for controlling the first power supply 220 so that the first comparative value is identical or substantially identical to the second comparative value, corresponding to the compared result of the comparator 130.

A first memory 221 stores a first digital value corresponding to a current that flows in the red pixels R when displaying full white light. Similarly, in the second power controller 260, a first digital value corresponding to a current that flows in the green pixels G when displaying full white light is stored in a corresponding first memory 221. In the third power controller 270, a first digital value corresponding to a current that flows in the blue pixels B when displaying full white light is stored in a corresponding first memory 221.

A second memory 222 stores a third digital value obtained by adding the bit values of the red data Data(R) when displaying full white light. Similarly, in the second power controller 260, a third digital value obtained by adding the bit values of the green data Data(G) when displaying full white light is stored in a corresponding second memory 222. Similarly, in the third power controller 270, a third digital value obtained by adding the bit values of the blue data Data(B) when displaying full white light is stored in a corresponding second memory 222.

A third calculator 223 generates a fourth digital value by adding the bit values of the red data Data(R) of a current frame. Similarly, in the second power controller 260, a third calculator 223 generates a fourth digital value by adding the bit values of the green data Data(G) of the current frame. Similarly, in the third power controller 270, a third calculator 223 generates a fourth digital value by adding the bit values of the blue data Data(B) of the current frame.

An operation of the first power controller 250 will be further described. First of all, the first power supply 220 generates the red first power ELVDD(R) and supplies the generated red first power ELVDD(R) to the red pixels R. Therefore, a current (e.g., a predetermined current) flows through the first sensing resistor Rs1, and amplifier 112 senses the current that flows through the first sensing resistor Rs1 to supply the sensed current to an ADC 114.

The current supplied to the ADC 114 is converted into a second digital value to be supplied to a first calculator 116. Here, the first calculator 116 generates a first comparative value by using the second digital value and the first digital value stored in the first memory 221, and supplies the generated first comparative value to the comparator 130.

The third calculator 223 generates the fourth digital value by adding the bit values of the red data Data(R) of a current frame, and supplies the generated fourth digital value to a second calculator 124. Here, the second calculator 124 generates a second comparative value by using the fourth digital value and the third digital value stored in the second memory 222, and supplies the generated second comparative value to the comparator 130.

The comparator 130, which receives the first and second comparative values respectively supplied from the first and second calculators 116 and 124, supplies a control signal to the controller 140, corresponding to the compared result of the comparator 130. Then, the controller 140 adjusts the voltage value of the red first power ELVDD(R) by controlling the first power supply 220 so that the first comparative value is identical or substantially identical to the second comparative value.

Similarly, the second power controller 260 and the third power controller 270 also adjust the voltage values of the green first power ELVDD(G) and the blue first power ELVDD (B), respectively, by repeating the same process illustrated in reference to the first power controller 250.

While the present invention has been described in connection with certain exemplary embodiments, it is to be understood that the present invention is not limited to the disclosed embodiments, but, on the contrary, is intended to cover various modifications and equivalent arrangements included within the spirit and scope of the appended claims, and equivalents thereof.

What is claimed is:

1. An organic light emitting display device comprising:

a scan driver for supplying a scan signal to scan lines during scan periods of a plurality of sub-frames included in one frame;

a data driver for supplying data signals to data lines when the scan signal is supplied;

pixels at crossing regions of the scan lines and the data lines, each of the pixels configured to control whether or not a current flows from a first power to a second power both coupled to the pixels, the current corresponding to a corresponding one of the data signals;

a power supply for supplying the first power to a power line coupled to the pixels;

a sensing resistor coupled between the power supply and the power line; and a power controller for controlling the power supply to adjust a voltage value of the first power to correspond to an amount of current that flows through the sensing resistor and data of a current frame, wherein the power controller comprises:

a first generator for generating a first comparative value by utilizing the amount of current that flows through the sensing resistor and an amount of current that would flow through the sensing resistor if the pixels emit full white light;

a second generator for generating a second comparative value by utilizing the data of the current frame and data for one frame in which the pixels emit full white light;

a comparator for generating a control signal while comparing the first comparative value with the second comparative value; and a controller for controlling the power supply in accordance with the control signal so that the first comparative value is substantially identical to the second comparative value.

2. The organic light emitting display device as claimed in claim 1, wherein the first generator comprises:

an amplifier for sensing an amount of current flowing across the sensing resistor;

an analog-to-digital converter for converting the amount of current sensed by the amplifier to a second digital value;

a first memory for storing a first digital value corresponding to the current that flows across the sensing resistor when the pixels emit full white light; and a first calculator for generating the first comparative value by dividing the second digital value by the first digital value.

3. The organic light emitting display device as claimed in claim 1, wherein the second generator comprises:

a second memory for storing a third digital value obtained by adding the data for one frame in which the pixels emit full white light;

a third calculator for generating a fourth digital value by adding the data of the current frame; and a second calculator for generating the second comparative value by dividing the fourth digital value by the third digital value.

4. The organic light emitting display device as claimed in claim 2, wherein the first digital value corresponds to a current that flows across the sensing resistor when the organic light emitting display device is driven at a temperature in the range of 10 to 30° C.

5. The organic light emitting display device as claimed in claim 4, wherein the first digital value corresponds to the current that flows across the sensing resistor when the organic light emitting display device is driven at a temperature substantially equal to 25° C.

6. An organic light emitting display device comprising:

a scan driver for supplying a scan signal to scan lines during scan periods of a plurality of sub-frames included in one frame;

a data driver for supplying data signals to data lines when the scan signal is supplied;

a display unit comprising red pixels, green pixels and blue pixels;

a first power supply for supplying a red first power to a first power line coupled to the red pixels;

a second power supply for supplying a green first power to a second power line coupled to the green pixels;

a third power supply for supplying a blue first power to a third power line coupled to the blue pixels;

a first sensing resistor coupled between the first power supply and the first power line;

a second sensing resistor coupled between the second power supply and the second power line;

a third sensing resistor coupled between the third power supply and the third power line;

a first power controller for controlling the first power supply to adjust a voltage value of the red first power to correspond to an amount of current that flows through the first sensing resistor and red data of a current frame;

a second power controller for controlling the second power supply to adjust a voltage value of the green first power to correspond to an amount of current that flows through the second sensing resistor and green data of the current frame; and a third power controller for controlling the third power supply to adjust a voltage value of the blue first power to correspond to an amount of current that flows through the third sensing resistor and blue data of the current frame, wherein each of the first power controller, the second power controller and the third power controller comprises:

a first generator for generating a first comparative value by utilizing the amount of current that flows through a sensing resistor of the first sensing resistor, the second sensing resistor or the third sensing resistor and a current that flows through the sensing resistor when the red pixels, the green pixels and the blue pixels emit full white light;

a second generator for generating a second comparative value by utilizing corresponding data of the red data, the green data or the blue data of the current frame and corresponding data of red data, green data or blue data of one frame in which the red pixels, the green pixels and the blue pixels emit full white light;

a comparator for generating a control signal while comparing the first comparative value with the second comparative value; and a controller for controlling a corresponding one of the first power supply, the second power supply or the third power supply in accordance with the control signal so that the first comparative value is substantially identical to the second comparative value.

7. The organic light emitting display device as claimed in claim 6, wherein the first generator comprises:

an amplifier for sensing an amount of current flowing across a sensing resistor of the first sensing resistor, the second sensing resistor or the third sensing resistor;

an analog-to-digital converter for converting the amount of current sensed by the amplifier to a second digital value;

a first memory for storing a first digital value corresponding to the current that flows across the sensing resistor when the red pixels, the green pixels and the blue pixels emit full white light; and a first calculator for generating the first comparative value by dividing the second digital value by the first digital value.

8. The organic light emitting display device as claimed in claim 6, wherein the second generator comprises:

a second memory for storing a third digital value obtained by adding data of the red data, the green data or the blue data for one frame in which the red pixels, the green pixels and the blue pixels emit full white light;

a third calculator for generating a fourth digital value by adding corresponding data of the red data, the green data or the blue data of the current frame; and a second calculator for generating the second comparative value by dividing the fourth digital value by the third digital value.

9. A method of driving an organic light emitting display device driven with one frame divided into a plurality of sub-frames, the method comprising:

storing a first digital value corresponding to a current that flows to pixels of the organic light emitting display when the pixels emit full white light;

storing a third digital value obtained by adding data corresponding to the full white light;

converting a current that flows to the pixels in a current frame into a second digital value, and generating a first comparative value by utilizing the first digital value and the second digital value;

generating a fourth digital value by adding data of the current frame to generate a second comparative value by utilizing the third digital value and the fourth digital value; and controlling a voltage value of a first power for supplying a current to the pixels so that the first comparative value is substantially identical to the second comparative value.

10. The method as claimed in claim 9, wherein the first comparative value is generated by dividing the second digital value by the first digital value.

11. The method as claimed in claim 9, wherein the second comparative value is generated by dividing the fourth digital value by the third digital value.

12. The method as claimed in claim 9, wherein the pixels comprises a red pixel for emitting red light, a green pixel for emitting green light, and a blue pixel for emitting blue light.

13. The method as claimed in claim 12, wherein the first digital value comprises a plurality of first digital values each corresponding to the red pixel, the green pixel or the blue pixel.

14. The method as claimed in claim 12, wherein the third digital value comprises a plurality of third digital values each corresponding to red data supplied to the red pixel, green data supplied to the green pixel or blue data supplied to the blue pixel.

15. The method as claimed in claim 14, wherein the fourth digital value comprises a plurality of fourth digital values each corresponding to red data, green data or blue data generated in the current frame.

16. The method as claimed in claim 12, wherein said controlling the voltage value of the first power comprises controlling a voltage value of red first power, green first power or blue first power for controlling a current supplied to a corresponding one of the red pixel, the green pixel or the blue pixel.

* * * * *